US006182409B1

(12) United States Patent
Visser

(10) Patent No.: US 6,182,409 B1
(45) Date of Patent: Feb. 6, 2001

(54) BUILDING ELEMENT

(76) Inventor: David Dirk Visser, Lot 4, Liverpool Rd., Kilsyth Victoria (AU)

( * ) Notice: Under 35 U.S.C. 154(b), the term of this patent shall be extended for 0 days.

(21) Appl. No.: 09/319,095

(22) PCT Filed: Nov. 28, 1997

(86) PCT No.: PCT/AU97/00806

§ 371 Date: May 28, 1999

§ 102(e) Date: May 28, 1999

(87) PCT Pub. No.: WO98/23823

PCT Pub. Date: Jun. 4, 1998

(30) Foreign Application Priority Data

Nov. 28, 1996 (AU) ..... P03899

(51) Int. Cl.[7] ..... E04C 3/00

(52) U.S. Cl. ..... 52/309.13; 52/309.8; 52/309.14; 52/309.15; 52/309.17; 52/284; 52/592.1; 52/794.1; 52/783.1; 52/783.13; 52/736.3; 52/737.4; 52/738.1

(58) Field of Search ..... 52/309.8, 309.12, 52/309.13, 309.14, 309.15, 309.17, 309.4, 404.1, 284, 592.1, 783.17, 794.1, 783.1, 783.13, 574, 736.3, 737.4, 738.1

(56) References Cited

U.S. PATENT DOCUMENTS 3,913,292 * 10/1975 Braekkan ..... 52/406.1
4,774,794 * 10/1988 Grieb ..... 52/309.17
5,115,621 * 5/1992 Kobayashi ..... 52/792.11
5,664,386 * 9/1997 Palmersten ..... 52/588.1
5,765,318 * 6/1998 Michelsen ..... 52/98
5,842,314 * 12/1998 Porter ..... 52/309.7
5,927,032 * 7/1999 Record ..... 52/309.11
6,006,480 * 12/1999 Rook ..... 52/309.12
6,096,416 * 8/2000 Altenberg ..... 428/317.7

FOREIGN PATENT DOCUMENTS 229435 12/1992 (NZ) .

* cited by examiner

*Primary Examiner*—Christopher T. Kent
*Assistant Examiner*—Jennifer I. Thissell
(74) *Attorney, Agent, or Firm*—Milde, Hoffberg & Macklin, LLP

(57) ABSTRACT

A building element (1) comprising an outer sheath and an inner core, the sheath being formed of a material having a greater tensile strength than compressive strength and the core having a greater compressive strength than tensile strength; wherein the outer sheath is longitudinally extending and has a first face (7) and a second face (8) which are spaced apart, first (9) and second (21) edges and a first and second end; wherein the first face (7) and the second face (8) are joined at the first (9) and second (21) edges to form the outer sheath as a continuous body, and wherein the first edge (9) and the second edge (21) are so shaped that the first edge (9) of one such building element (1) is adapted to locate in the second edge (21) of another such building element (1).

11 Claims, 26 Drawing Sheets

31
31A
30
37
27
28
29
38

FIG.23
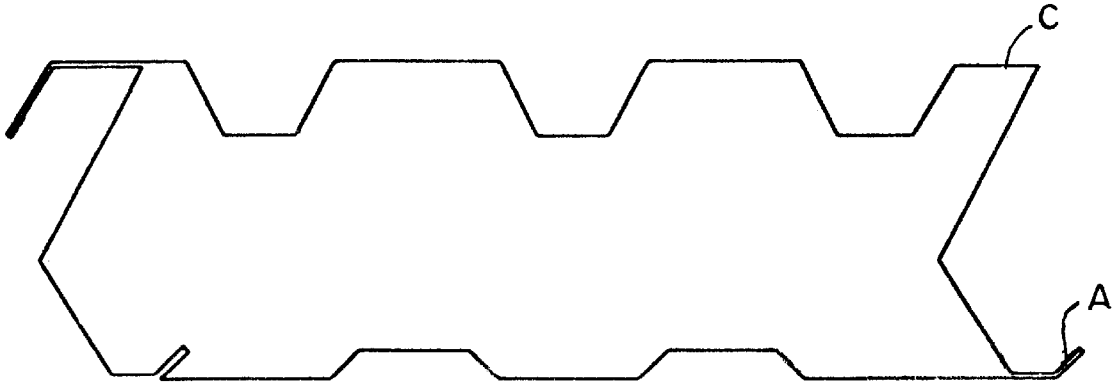
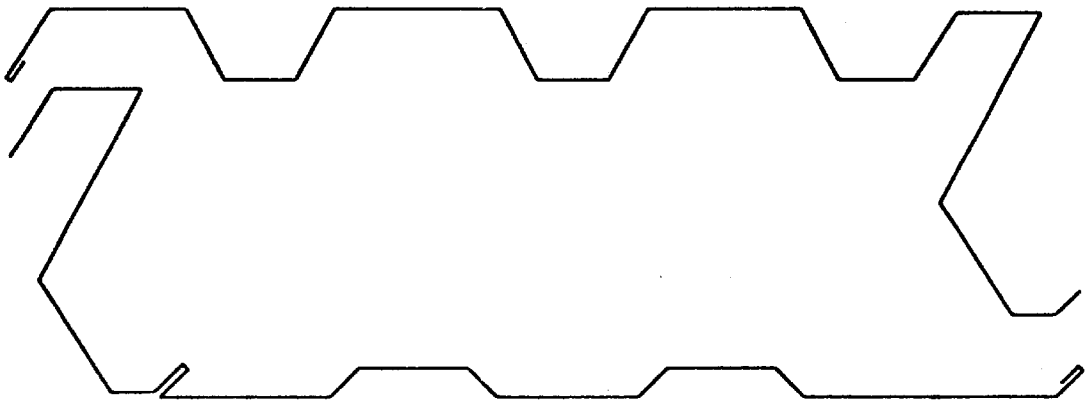
FIG.22

BUILDING ELEMENT

FIELD OF THE INVENTION

This invention relates to a building element.

BACKGROUND TO THE INVENTION

There is a need for a light weight building element which in its own right has structural integrity and which can be coupled with other such light building elements for the purposes of building panels, walls and various structural components in the formation of buildings.

It is an important consideration that such structural elements have significant strength and should have a reasonably high resistance to fire.

Classically in order to provide both the compressive strength and the tensile strength required of building elements, steel reinforcement (which has tensile strength) has been provided within concrete (which has compressive strength). However the resulting elements, because of the density of the concrete, have been heavy and not readily manipulable when manufactured in the form of prefabricated panels, columns and the like.

This problem of the weight of composite steel in concrete structures is not solved by using a low density material such as aerated concrete to carry the compressive loads. This is because steel-reinforced concrete relies on bonding between the concrete and the steel reinforcing. This bonding effect is not possible with aerated concrete. The light weight of aerated concrete is achieved by the presence of air pockets within the bulk of the concrete. The presence of these air pockets results in a lower steel to concrete bonding area, and far less effective bonding. There are similar difficulties in obtaining adhesion or bonding between reinforcing steel and other light weight alternatives to conventional concrete.

SUMMARY OF THE INVENTION

The present invention provides:

a building element comprising an outer sheath and an inner core, and being able to carry either or both of tensile loadings and compressive loadings without adhesion between the outer sheath and the inner core, the sheath being formed of a material having a greater tensile strength than compressive strength;

and the core being formed of a material having:

a greater compressive strength than tensile strength; and a density of less than 1,200 kg/cu meter;

wherein the outer sheath is longitudinally extending and has a first face and a second face which are spaced apart, first and second edges and a first end and a second end, wherein the first face and the second face are joined at the first and second edges to form the outer sheath as a continuous body, and wherein the first edge and the second edge are so shaped that the first edge of one such building element is adapted to locate in the second edge of another such building element.

PREFERRED ASPECTS OF THE INVENTION

Preferably the first end and the second end are so shaped that the first end of one such building element is adapted to engage with the second end of another such building element.

However, plain ends may be acceptable in some instances.

Preferably the sheath comprises at least two components which can interengage with one another to form the sheath. In one instance the sheath comprises four components.

In the last instance, two components define the faces and two components define the edges.

A plurality of such building elements may be assembled edge to edge to form walls, floors, roof, cladding or other parts of a building.

The building elements may extend horizontally, vertically or as desired.

The material of which the sheath is formed need only satisfy the tensile strength requirement.

Suitable materials for the sheath include mild steel, high tensile steel, carbon fibre materials, extruded materials, synthetic plastic-cement fibre composite and asbestos cement or modem replacement therefor.

The material of which the core is formed need only satisfy the compressive strength requirement.

However, the material of the core desirably has a substantially higher resistance to fire than the material of the sheath.

The preferred material of the core is a cementitious material. An alternative core material is a non-fire resistant material of low density, displaying a degree of compression resistance. Foamed plastics, eg polystyrene, and other materials such as recycled paper and recycled plastics may be used.

A most preferred cementitious material is a light weight concrete.

One suitable concrete is aerated concrete. Aerated concrete has a density of 200–1200 kg/cu meter, and although it is referred to in the art as 'concrete' is not strictly concrete because it does not contain aggregate.

Desirably, the spacing between the first edge and the second edge does not exceed 450 mm with 200–300 mm being preferred.

The spacing between the first and the second faces depends on the design loads for the building element. These edges may be closely spaced, and as a practical matter their maximum spacing is unlikely to exceed 150mm, depending on the application.

Preferably the first face and the second face and/or the first edge and the second edge are joined by at least one web located intermediate of the edges.

Said at least one web is preferably apertured.

This last has a number of advantages including that the amount of material in the web is reduced, so that the core material on one side of the web is integrally connected to the core material on the other side of the web, so as to reduce the amount of material available for heat conduction, as a stabiliser in manufacturing and to provide a continuous tensile shell enabling point stress loads to transfer to the outer sheath.

Several such webs may be used.

The length of the building element is not critical but for practical purposes is unlikely to exceed 8 meters.

In a preferred aspect the present invention provides a building element comprising an outer sheath and an inner core, and being able to carry either or both of tensile loadings and compressive loadings without adhesion between the outer sheath and the inner core, the sheath being formed of a material having a greater tensile strength than compressive strength;

and the core being formed of a material having:

a greater compressive strength than tensile strength; and a density of less than 1,200 kg/cu meter;

wherein the first edge and the second edge are so shaped that the first edge of one such building element is adapted to locate in the second edge of another such building element and wherein, when so located, the core material of said one such panel is spaced not more than 3 mm from the core material of said another panel.

Preferably that spacing of the core material of said one panel and the core material of said another panel does not exceed 1 mm.

Preferably the first edge defines a tongue and the second edge defines a groove.

Preferably the core material extends into the tongue.

The core material may extend into the portion of the sheath defining the groove but this is not preferred.

Preferably the groove is of such depth as to overly the first and second faces of such a building element when the tongue is entered into the groove of another such building element.

Preferably the building element, in the region of the groove, has a groove width, measured between the first face and the second face, of about the spacing of the first face and second face less four times the thickness of the sheath material.

Specific embodiments of building elements in accordance with this invention as applied to building panels will now be described by way of non-limiting example with reference to the accompanying drawings.

BRIEF DESCRIPTION OF THE VIEWS OF THE DRAWINGS

FIG. 22 is a drawing of components for another building element, FIG. 23 is a drawing of the components of FIG. 22 in assembled form.

INTEGER LIST

Figure 1:
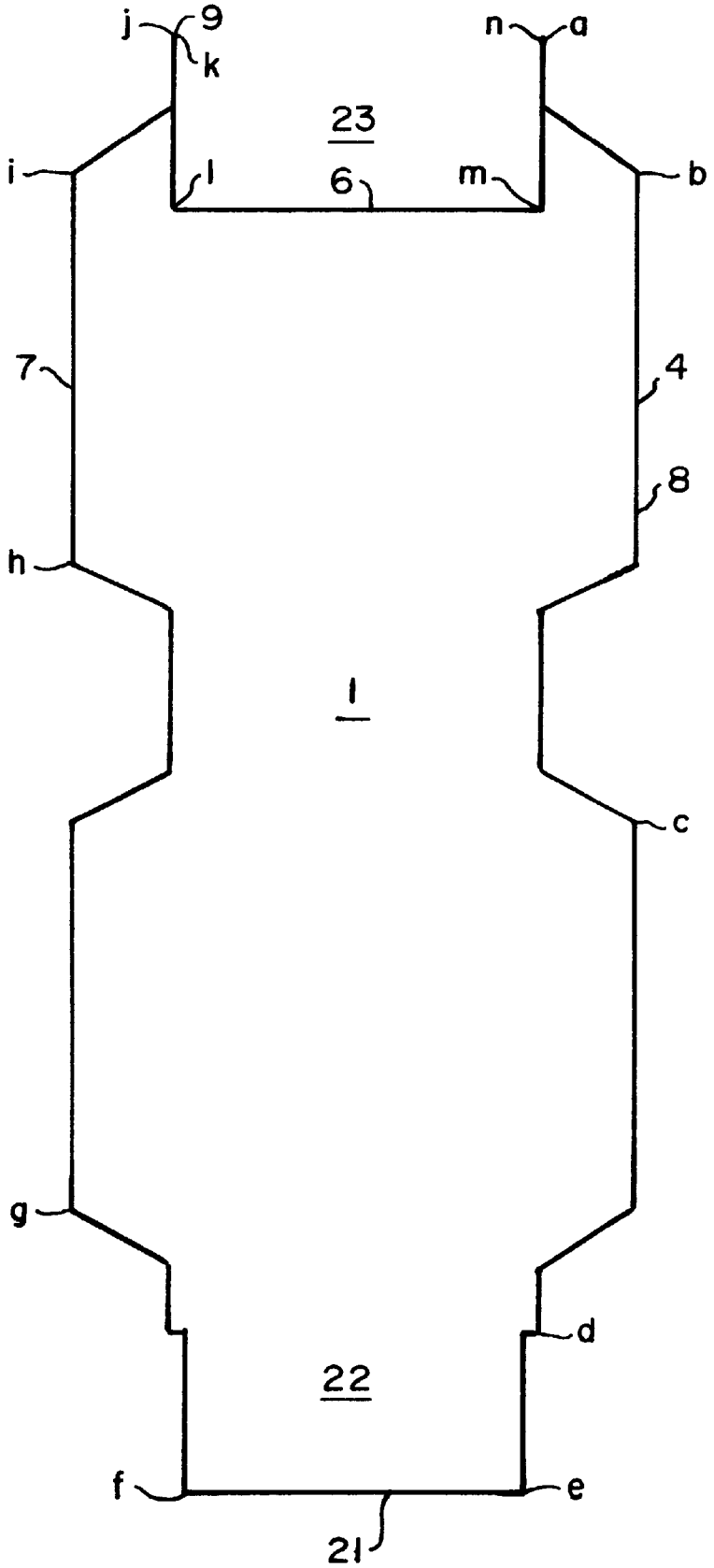
FIG. 1 is a cross-sectional view through a building panel.
Figure 3:
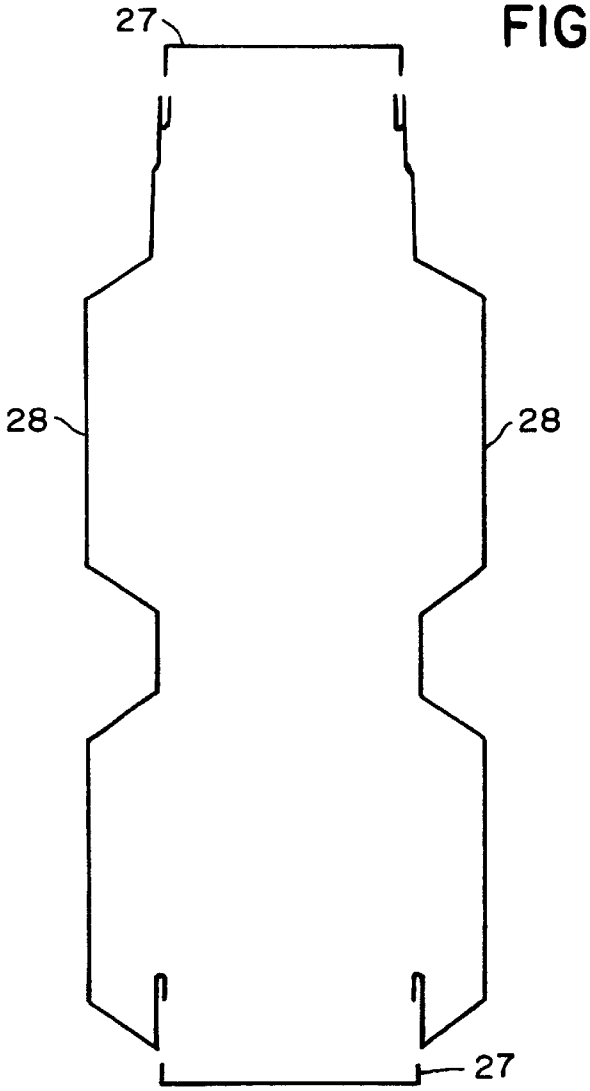
FIG. 3 is a cross-sectional view showing the component parts used to make up the building panel of FIG. 2.

1. Building panel
2. Outer sheath
3. Core
4. Panel portion a–j
6. Panel portion k–n
7. First face
8. Second face
9. First edge
21. Second edge
22. Tongue
23. Groove
26. Building panel
27. Component
28. Component
31. Panel
32. First end
33. Second end

DETAILED DESCRIPTION WITH RESPECT TO THE DRAWINGS

In FIG. 1 is shown a building panel 1 which comprises an outer sheath 2 and a core 3.

The outer sheath 2 is made of metal in a preferred form although other materials may be used.

The core 3 is made of lightweight concrete in a preferred form although other materials can be used.

The building panel 1 comprises a panel portion 4 which extends from a–j and a panel portion 6 which extends from k–n.

The panel portions 4 and 6 are crimped together so as to make a whole.

The building panel 1 has a first face 7 and a second face 8.

The building panel 1 also has a first edge 9 and a second edge 21.

The edges are so formed as to define a tongue 22 and a groove 23.

When another such panel as is shown in FIG. 1 is brought into juxtaposition with the building panel 1 the appropriate tongue can enter into the appropriate groove and will result in a strong construction.

Further, the thickness of the outer sheath is so chosen that desirably the cores of the two building panels are not more than 1 mm spaced from one another. This should give superior fire resistance.

As a consequence, the building panel 1 is of strong construction and is suitable for extensive use in the building industry for forming walls, floors, roofs, and other components of a building. For example, when the panel is used in a wall construction, the core 3 carries any vertical, compressive loads on the wall. Any tensile loads on the panel caused by sideways forces are carried by the sheath 2.

As will be observed, the building panel 1 is comprised of two components only being the panel portion 4 and panel portion 6.

Figure 2:
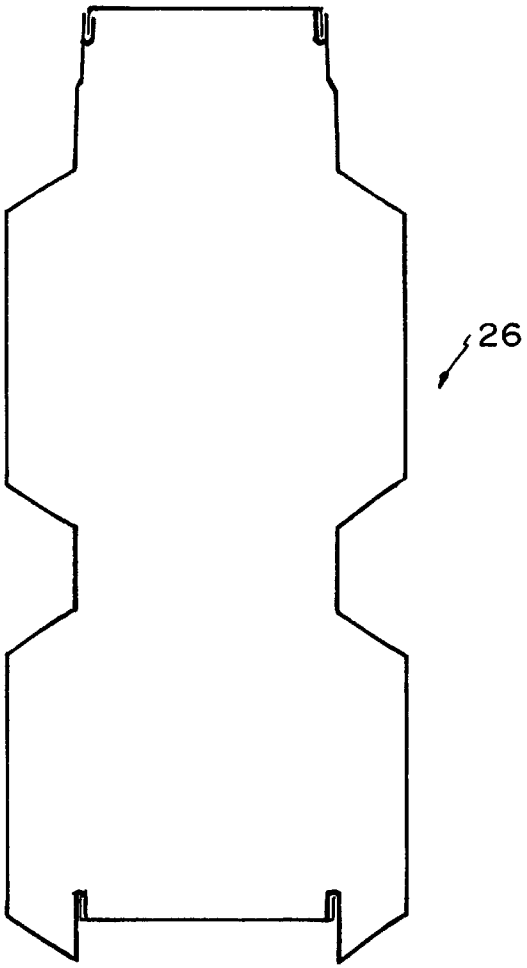
FIG. 2 is a cross-sectional view through another building panel.
Figure 4:
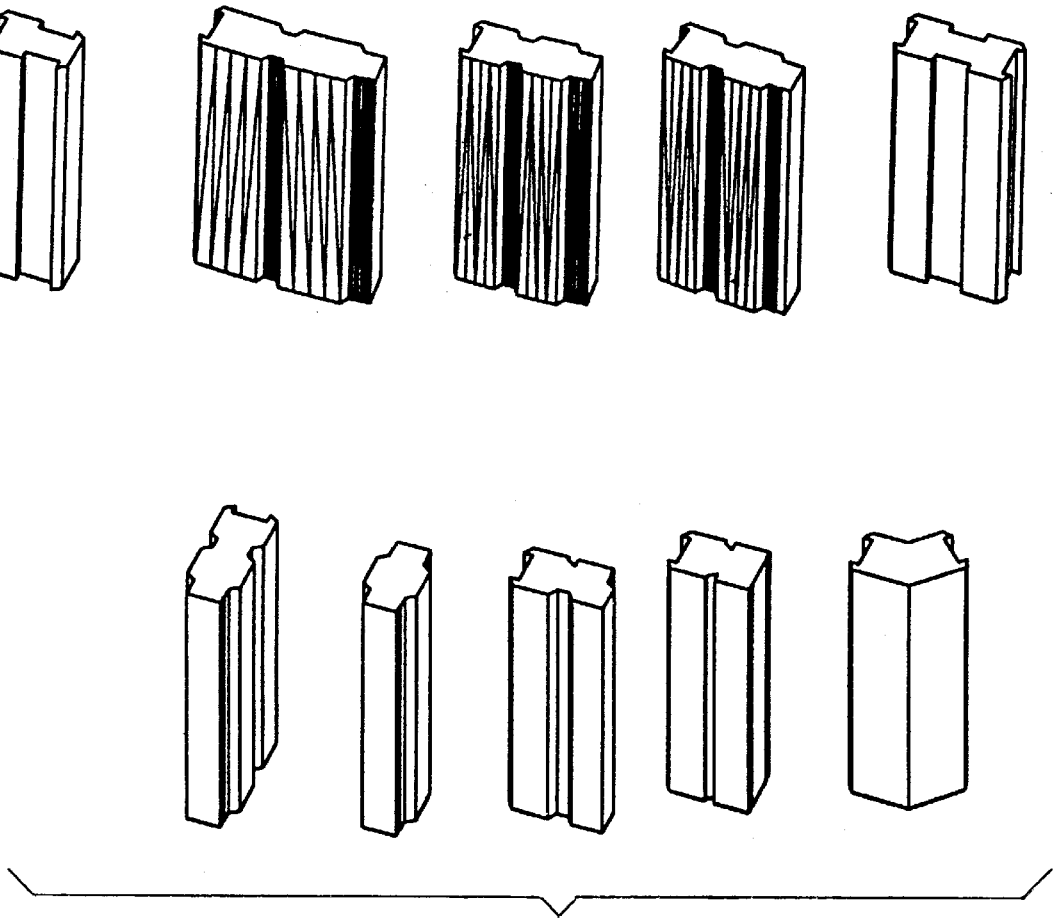
FIG. 4 shows various building panels in isometric view.
Figure 5:
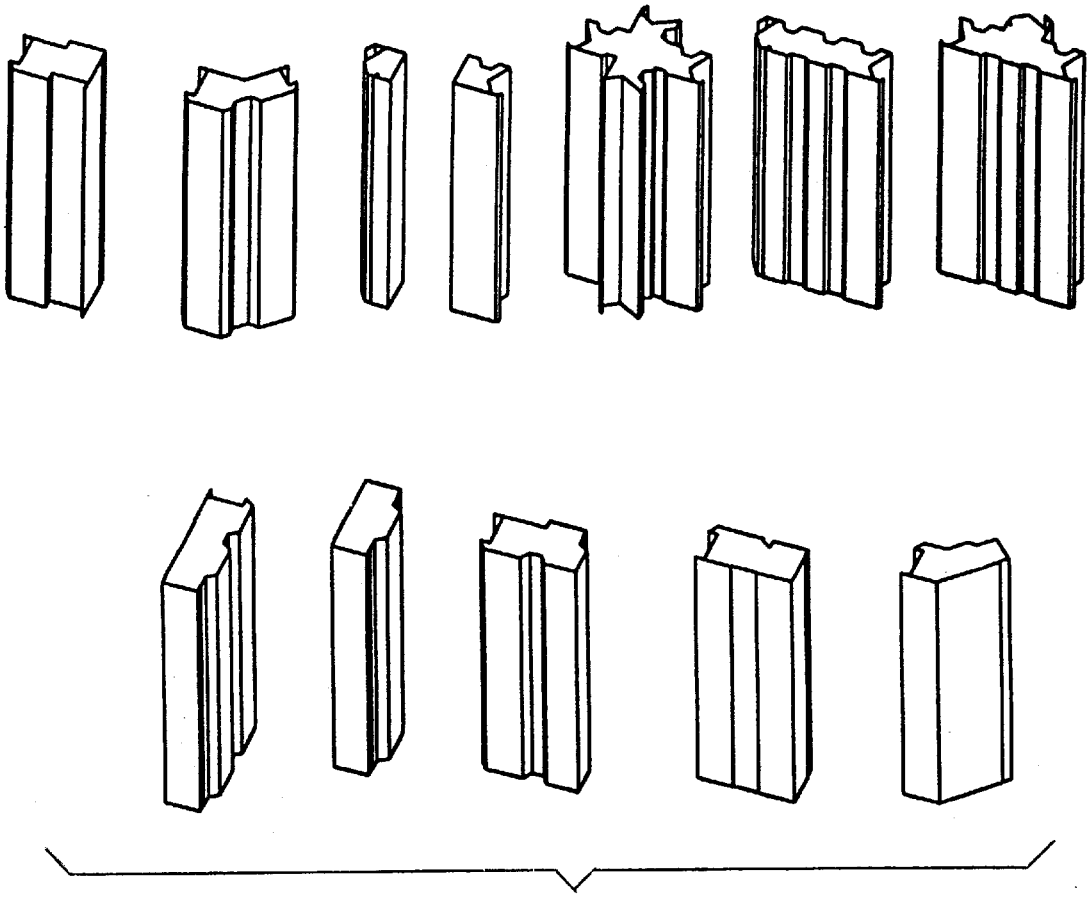
FIG. 5 shows various building panels in isometric view.

The building panel 26 shown in FIG. 2 comprises four components 28 and 29 but it is to be noticed that two of the components, 28 are identical one to the other and the other two components 27 are also identical to one another.

Figure 6:
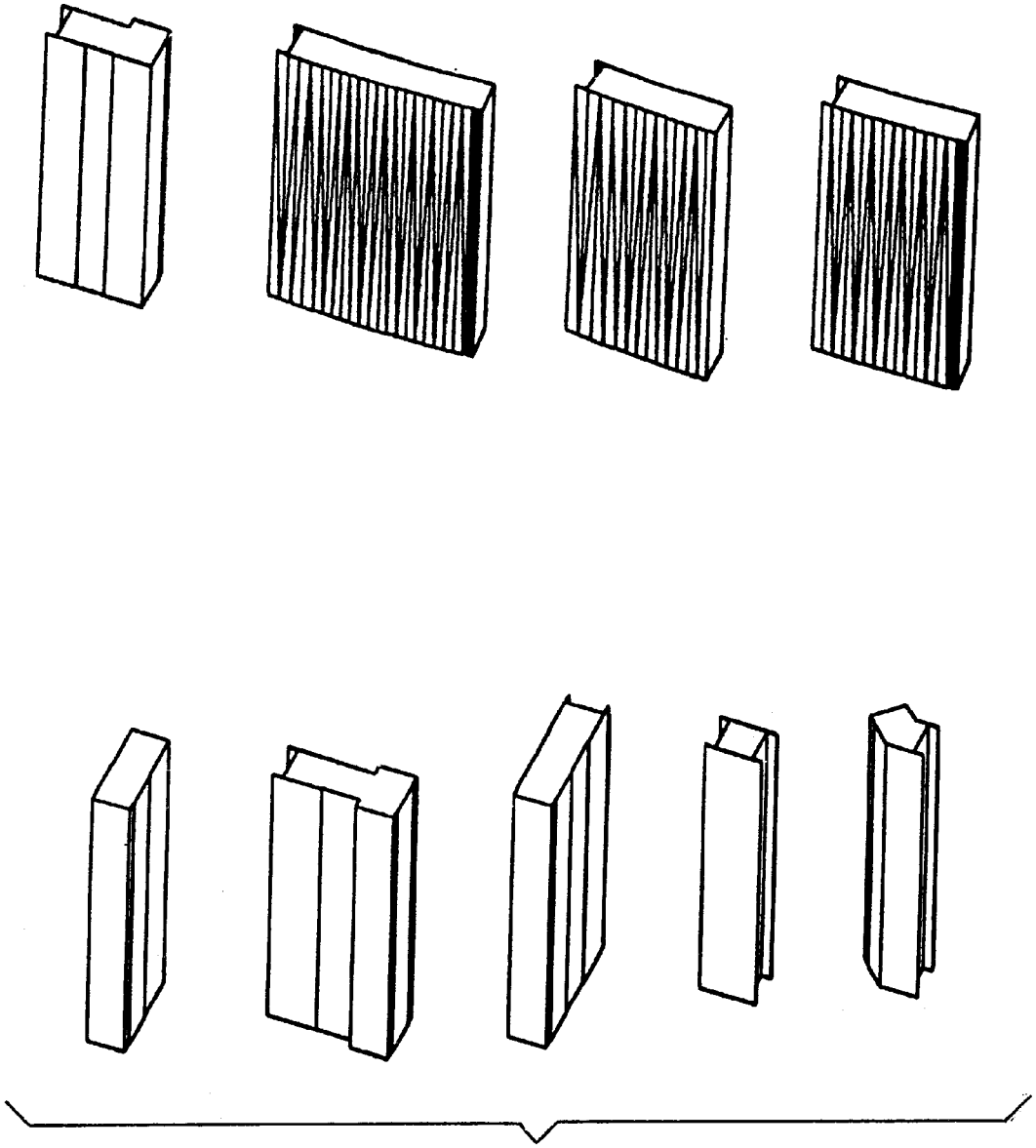
FIG. 6 shows various building panels in isometric view.
Figure 7A:
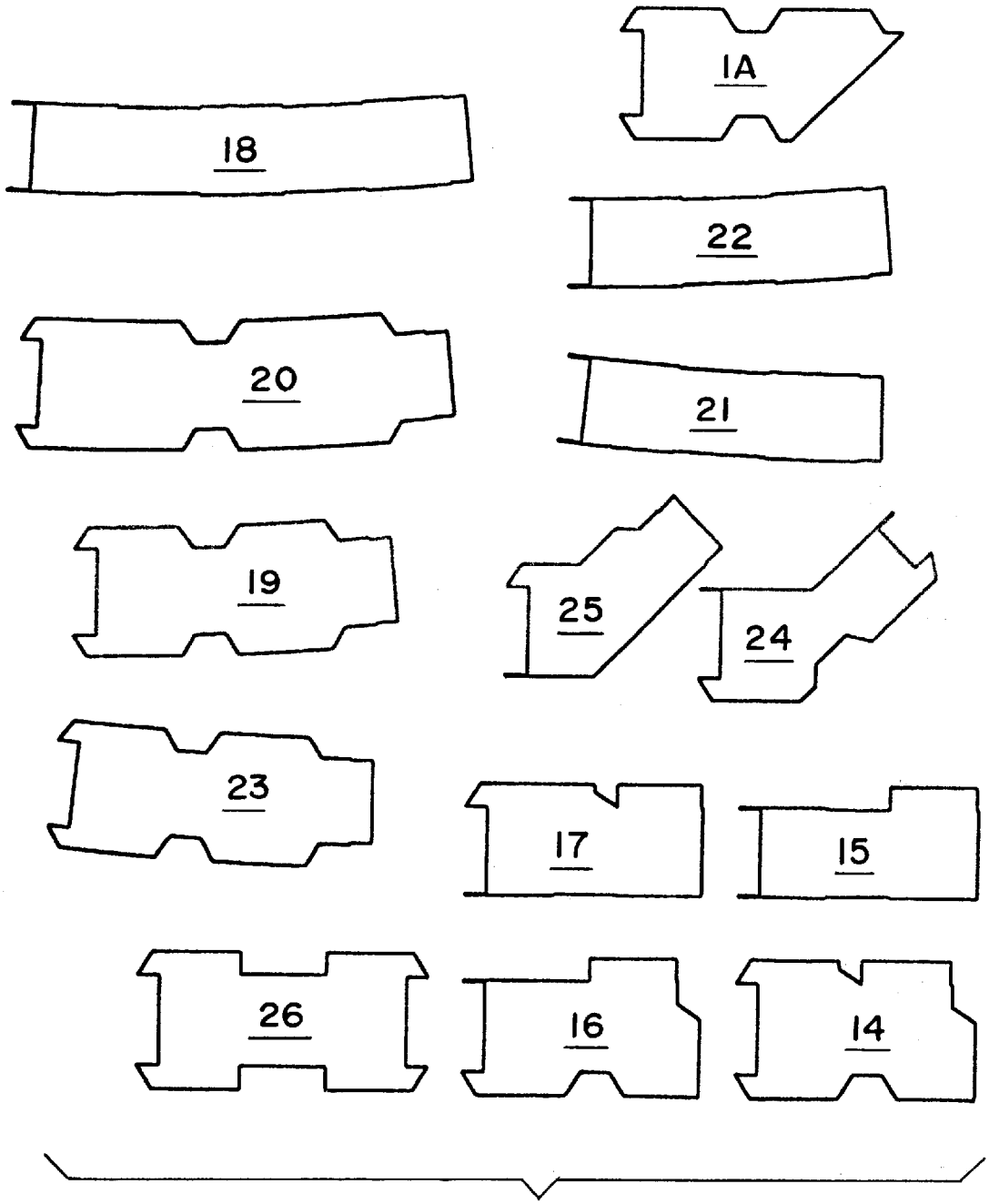
FIG. 7 shows various building panels in end view.
Figure 7B:
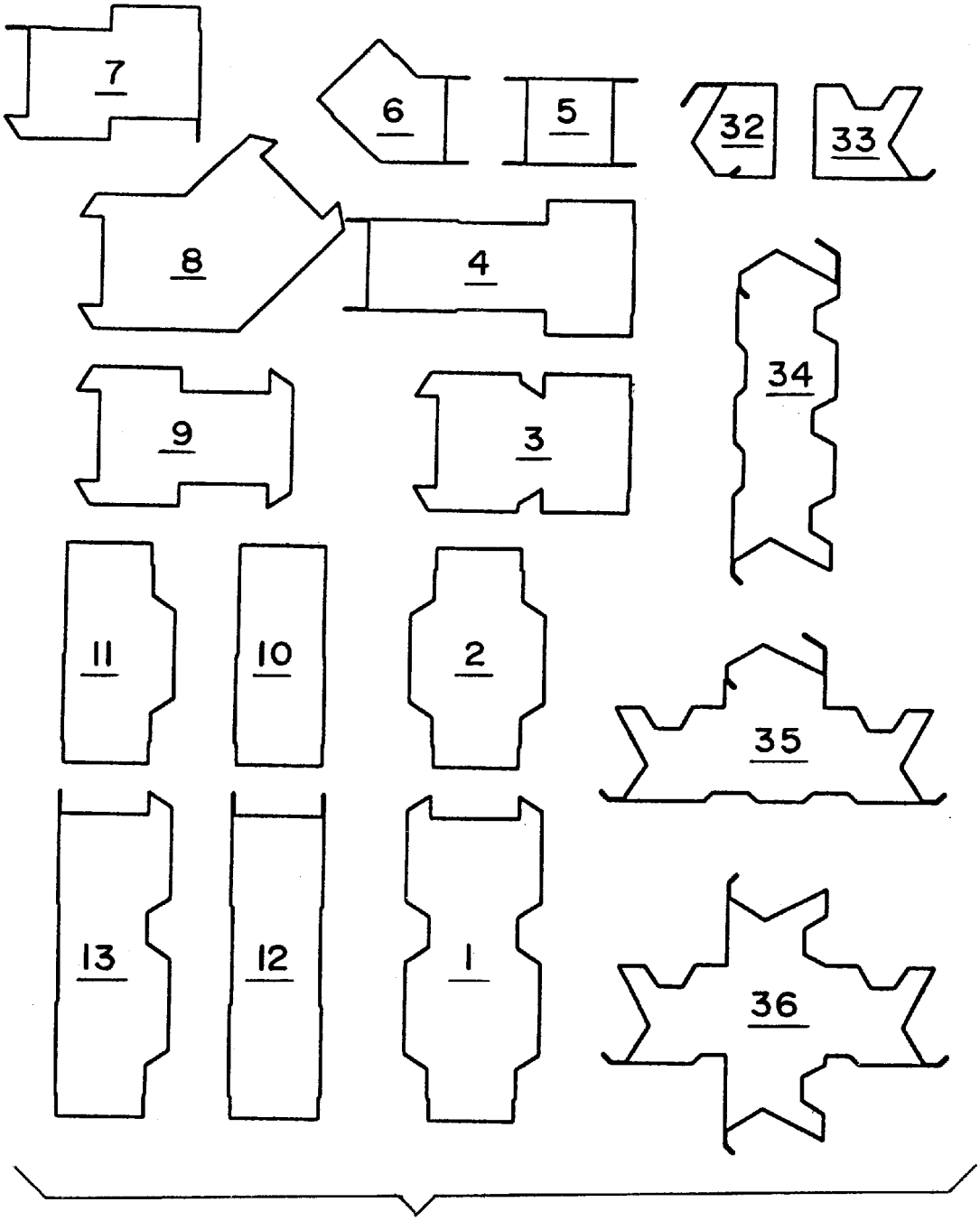
Figure 8:
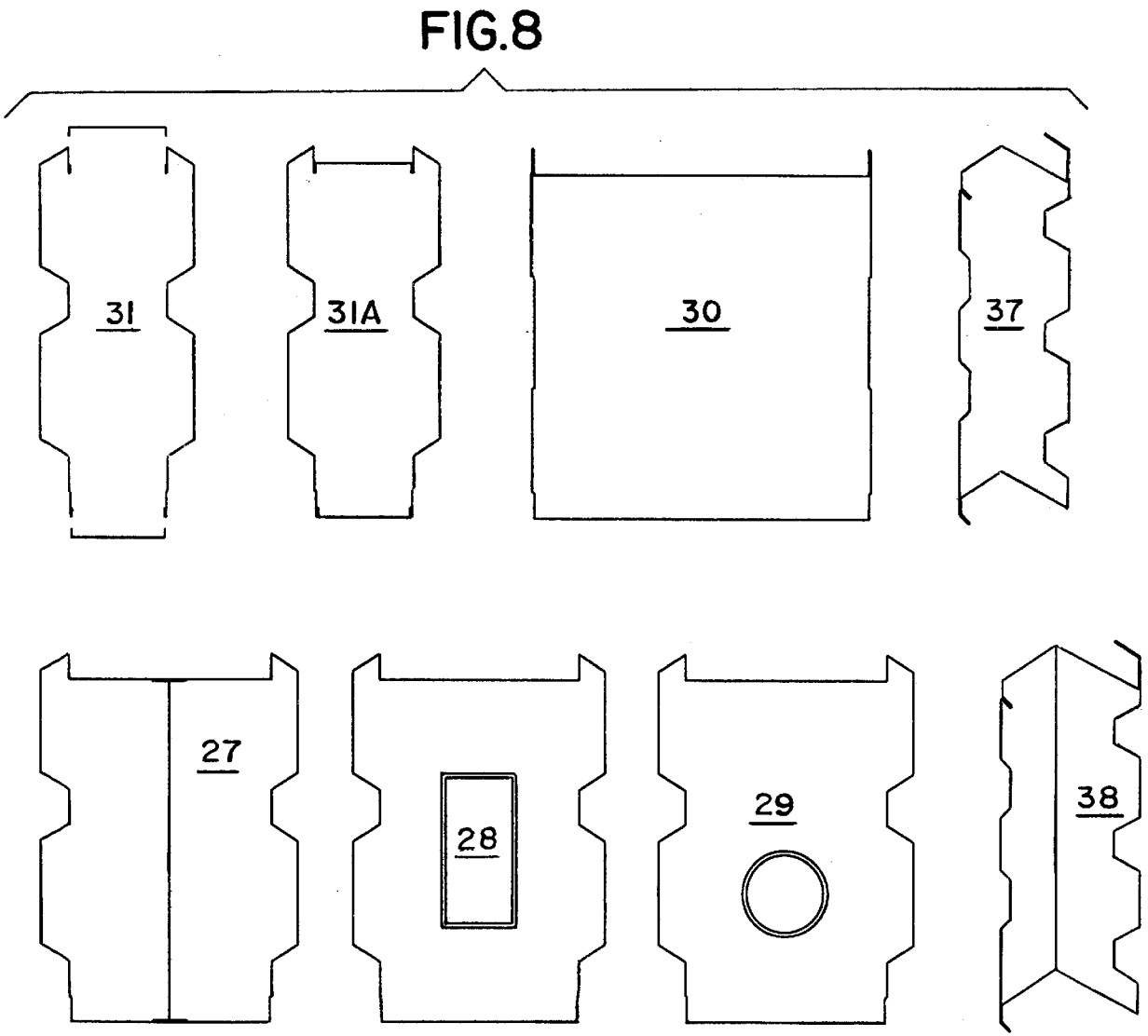
FIG. 8 shows various building panels in end view.

Building panels in accordance with this invention can take many sizes shapes and form some of which are illustrated in FIG. 6 and others are illustrated in FIGS. 7 and 8.

Referring to the items 27, 28 and 29 in FIG. 8, these are of substantial size and may be used for load bearing.

Figure 9:
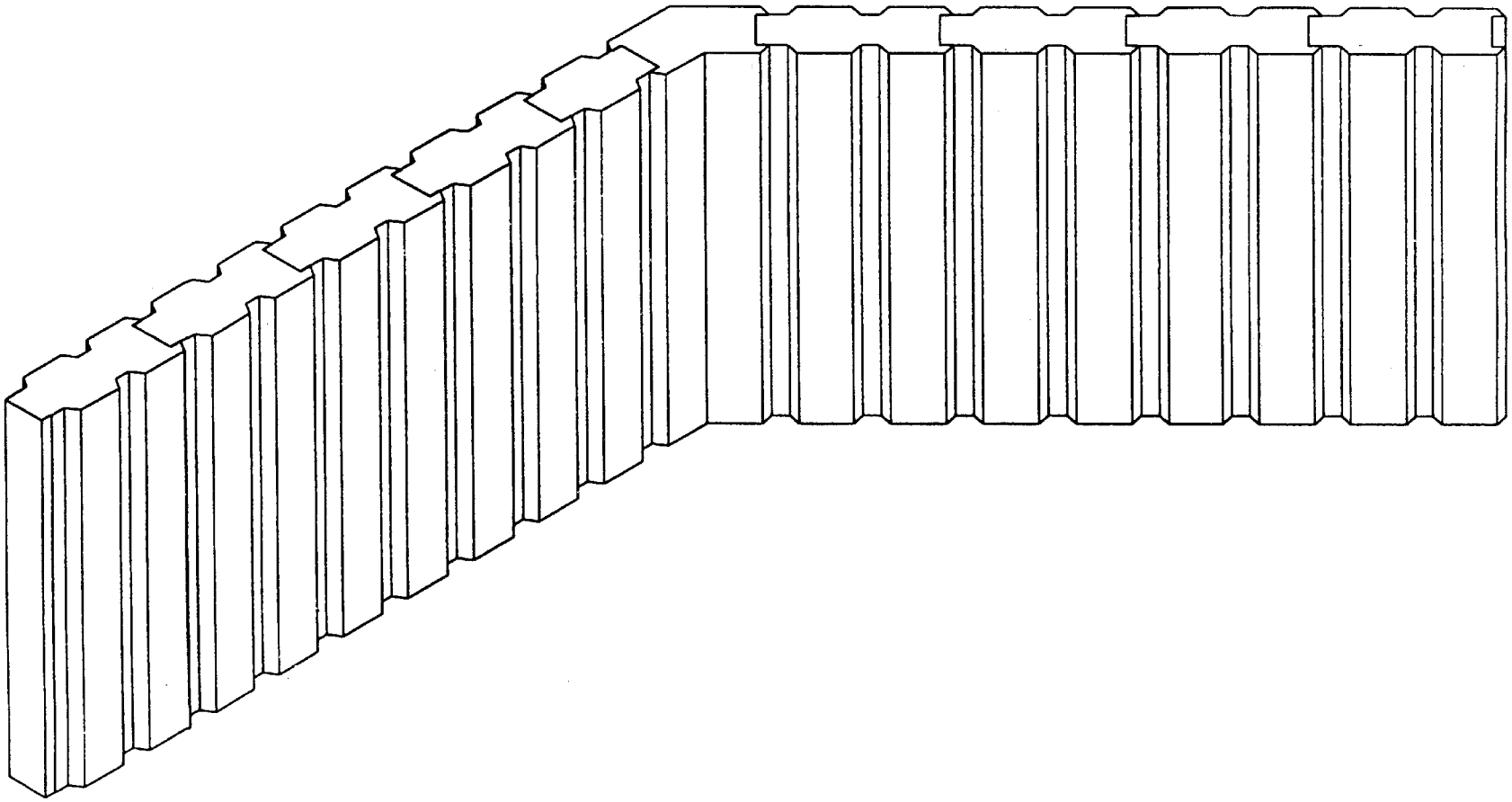
FIG. 9 shows a wall element using some of the previously mentioned building panels.
Figure 10:
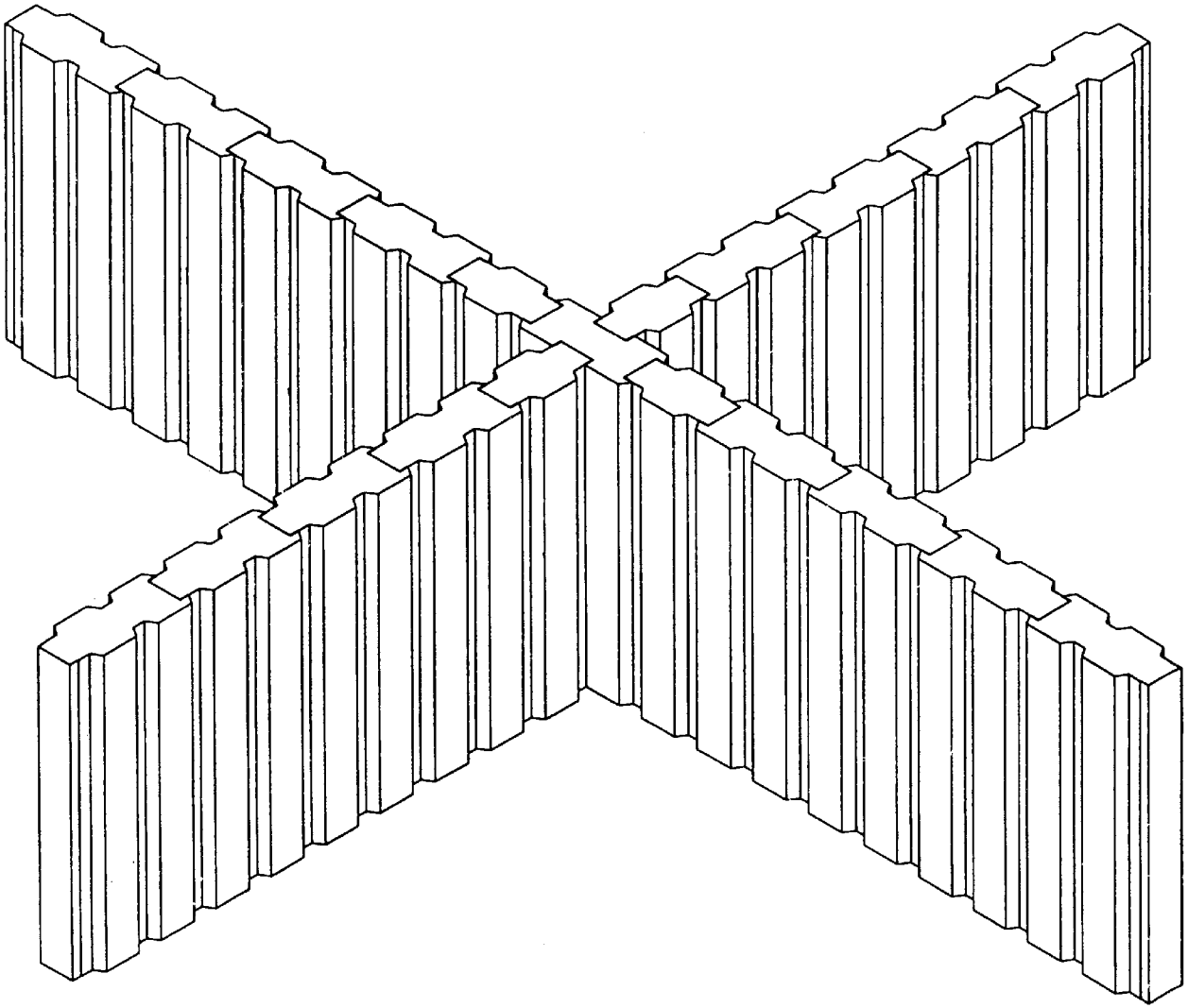
FIG. 10 shows a wall element using some of the building panels previously referred to, FIG. 11 shows joiner members which can be used in certain circumstances.

Various walls or other structures may be made from the building panels of this invention and some of these are illustrated in FIGS. 9 and 10.

Figure 11:
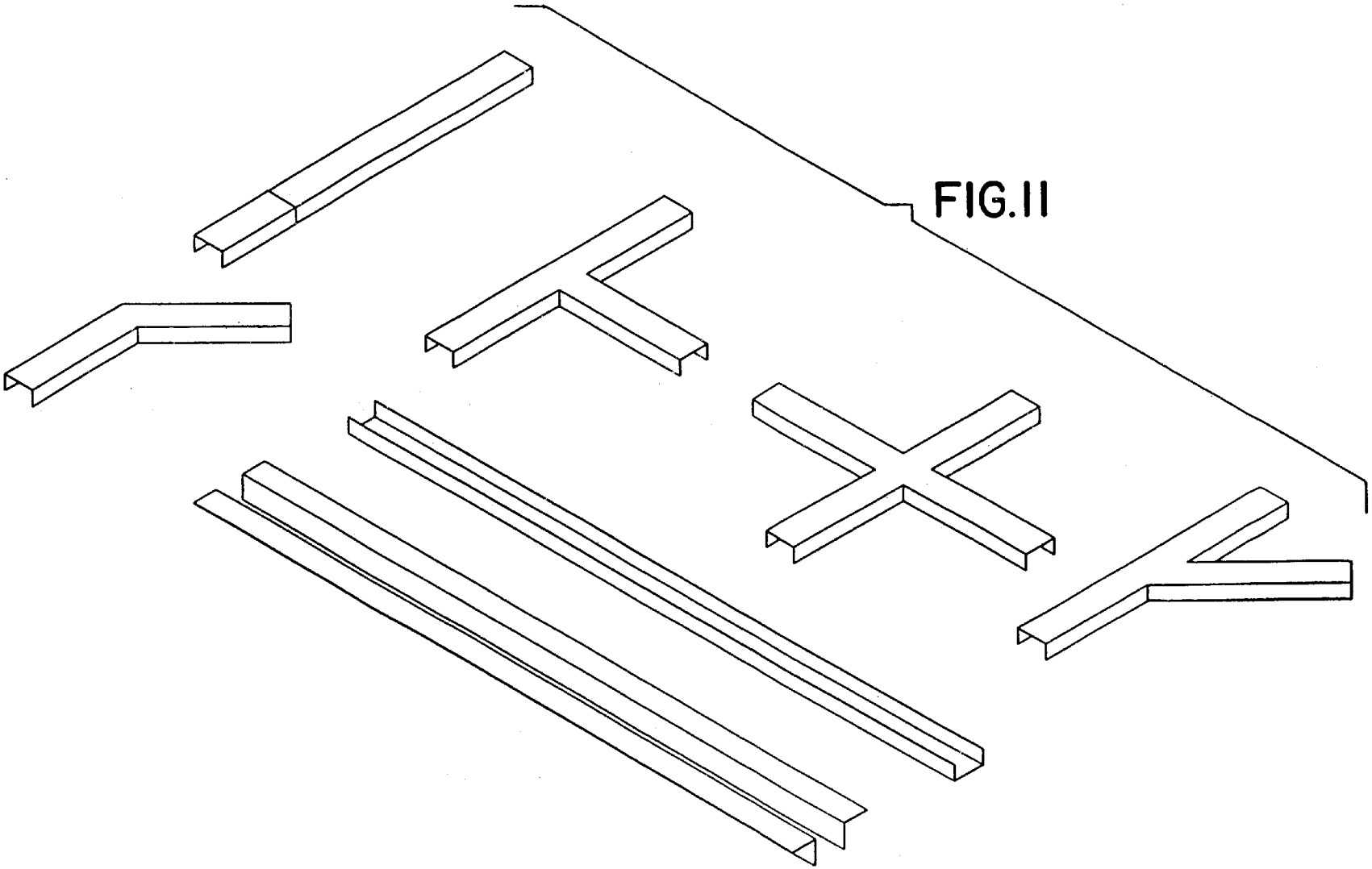
Figure 12:
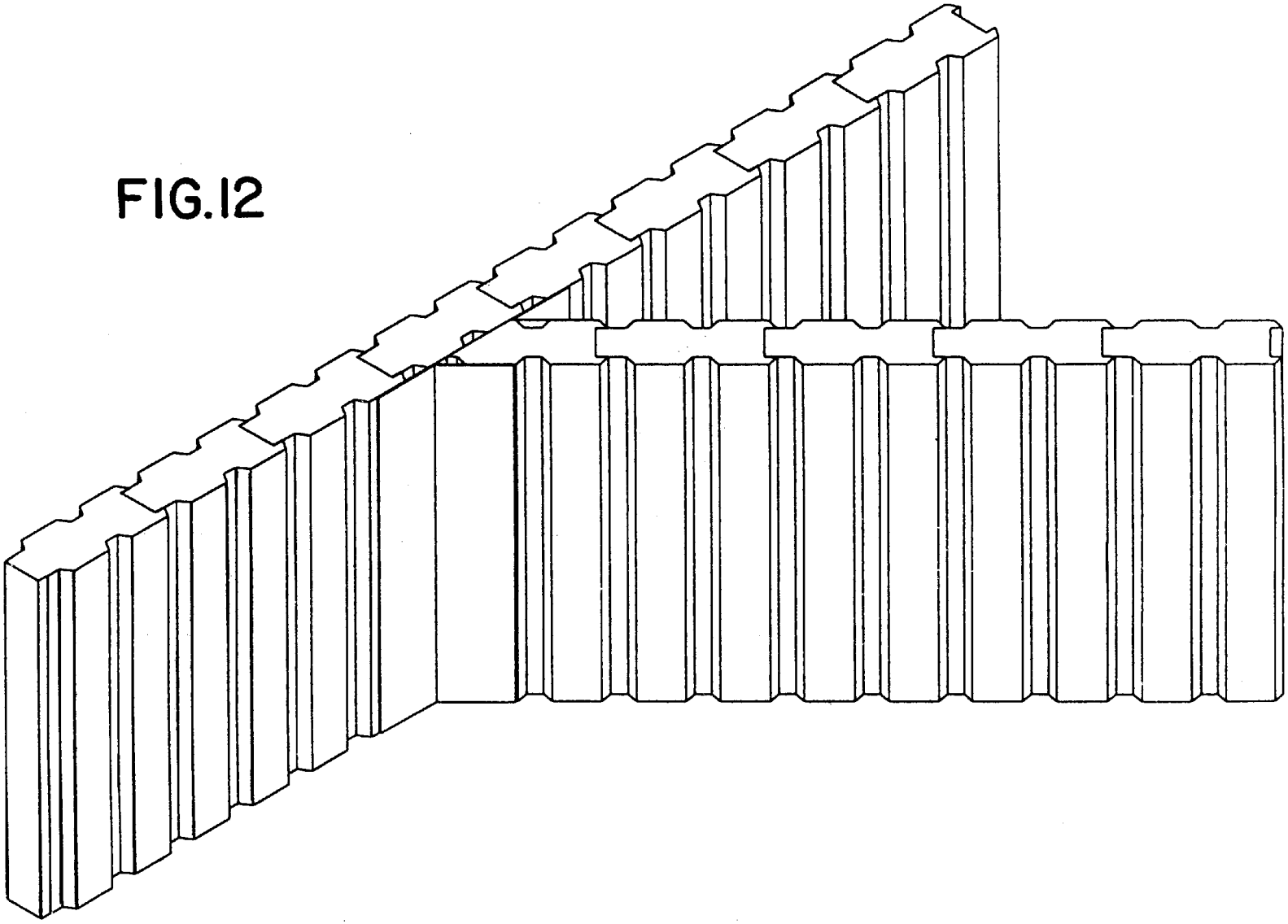
FIG. 12 shows a wall element comprised of certain of the previously referred to building panels.
Figure 13:
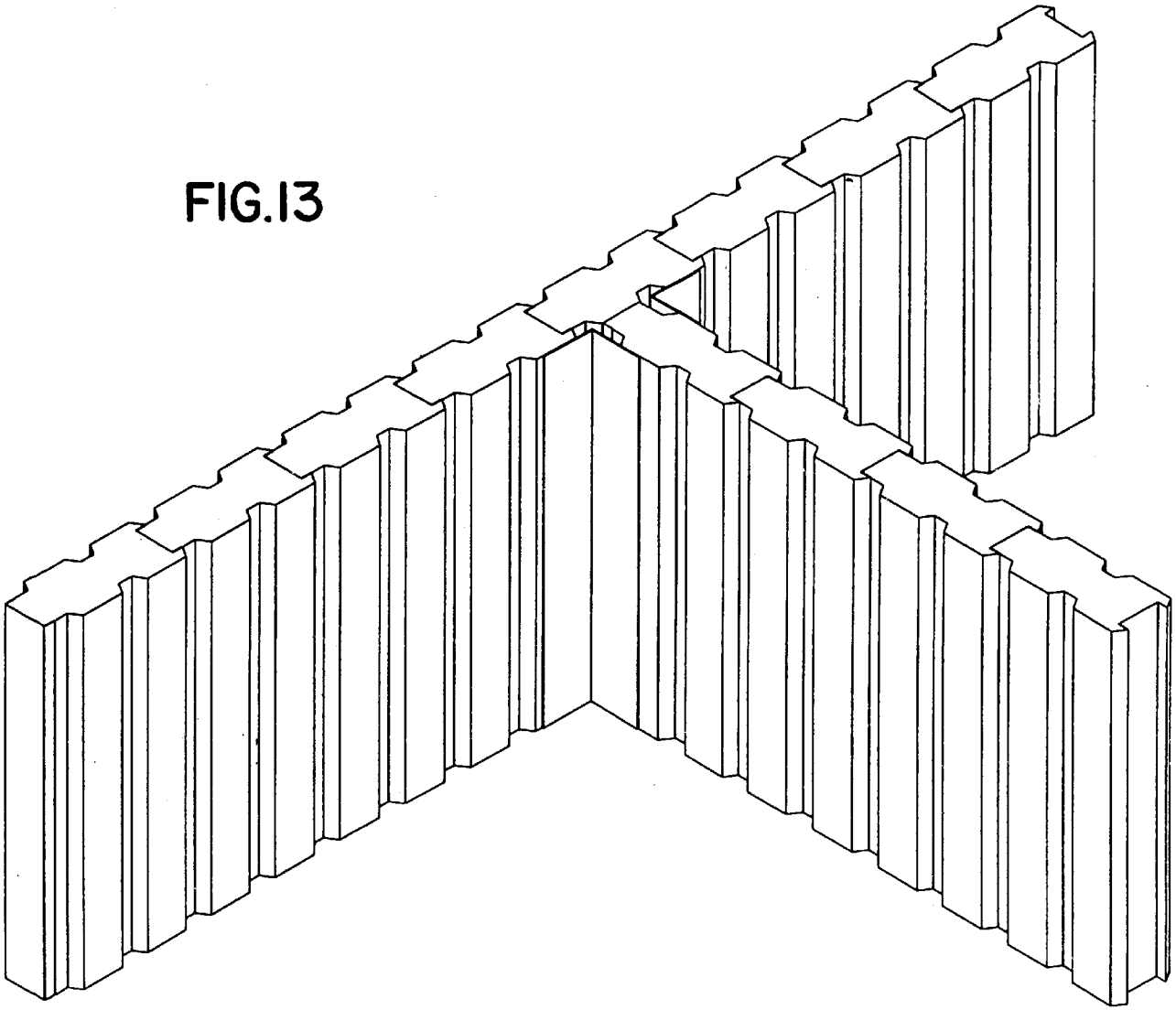
FIG. 13 shows a wall element comprised of various of the previously shown building panels.
Figure 14:
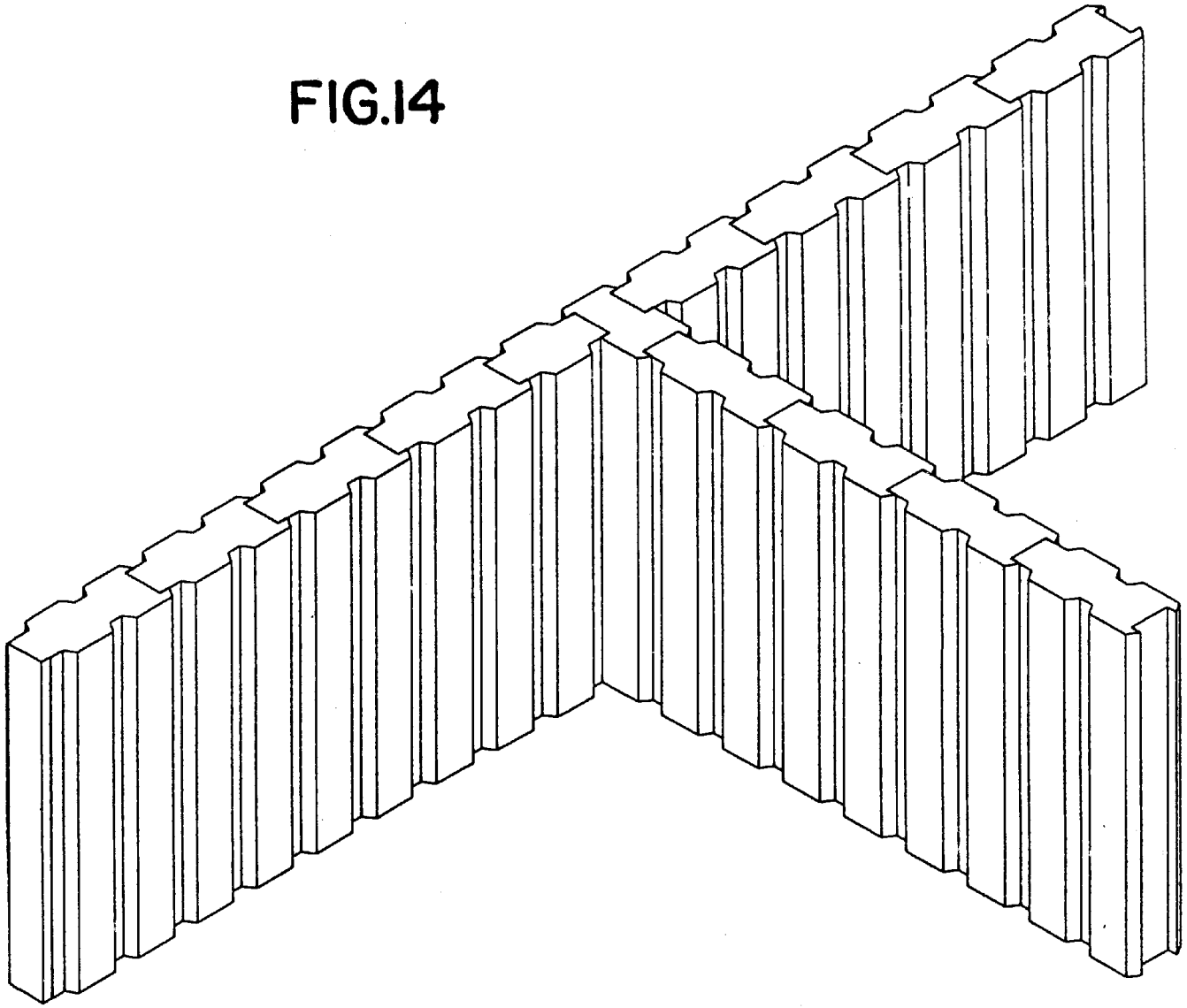
FIG. 14 shows a wall element comprised of various of the previously shown building panels.
Figure 15:
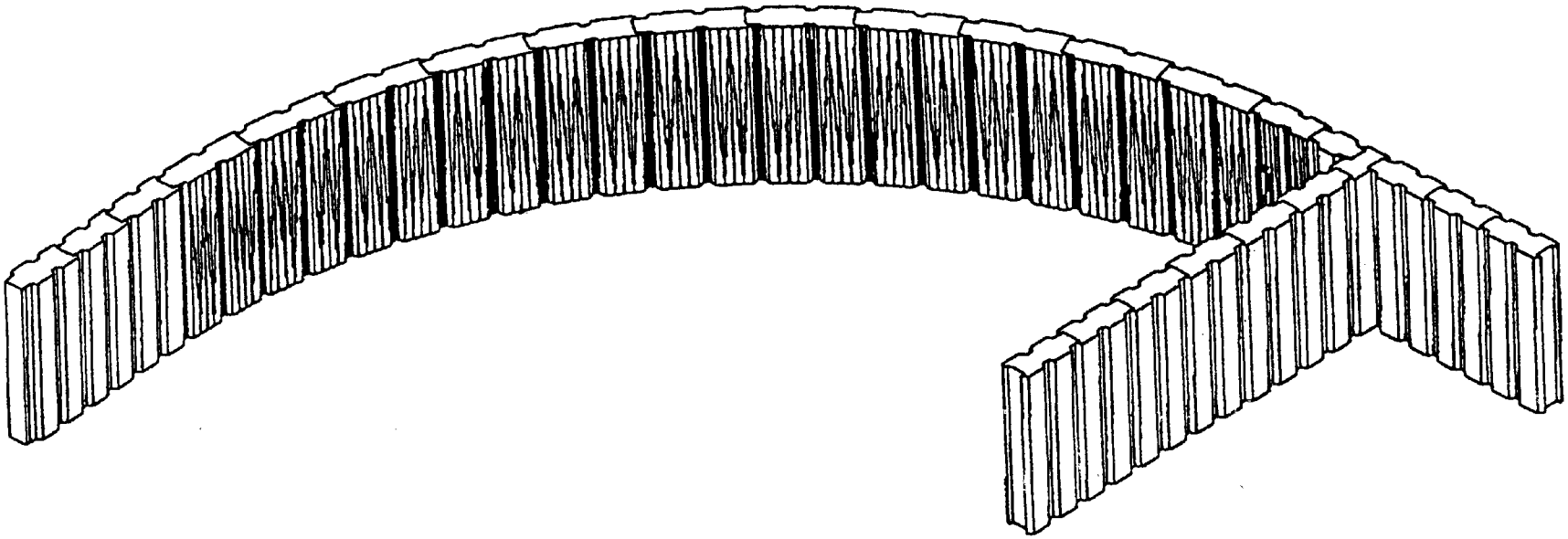
FIG. 15 shows a wall element comprised of various of the previously shown building panels.

For the purposes of capping upper ends or ends of sheets constructed from a number of building panels, there may be used various finishing members such as is shown in FIG. 11.

FIGS. 12, 13, 14 and 15 show other constructions that can be made.

Figure 16:
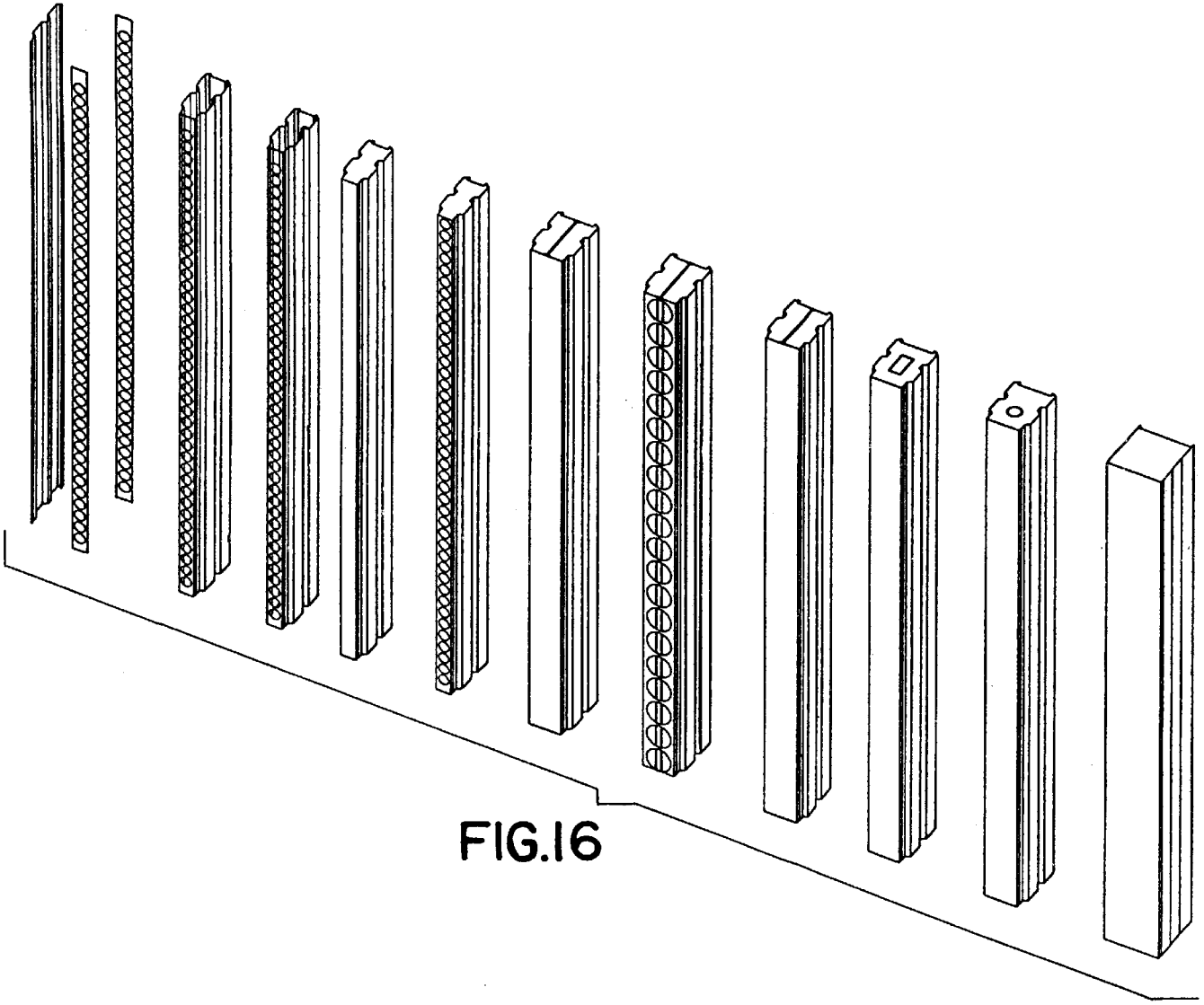
FIG. 16 shows alternative building panels.

FIG. 16 shows yet further forms of building panels in which the tongue, at least, is apertured so that the core material may be brought into close contact with an adjacent building panel.

Figure 17:
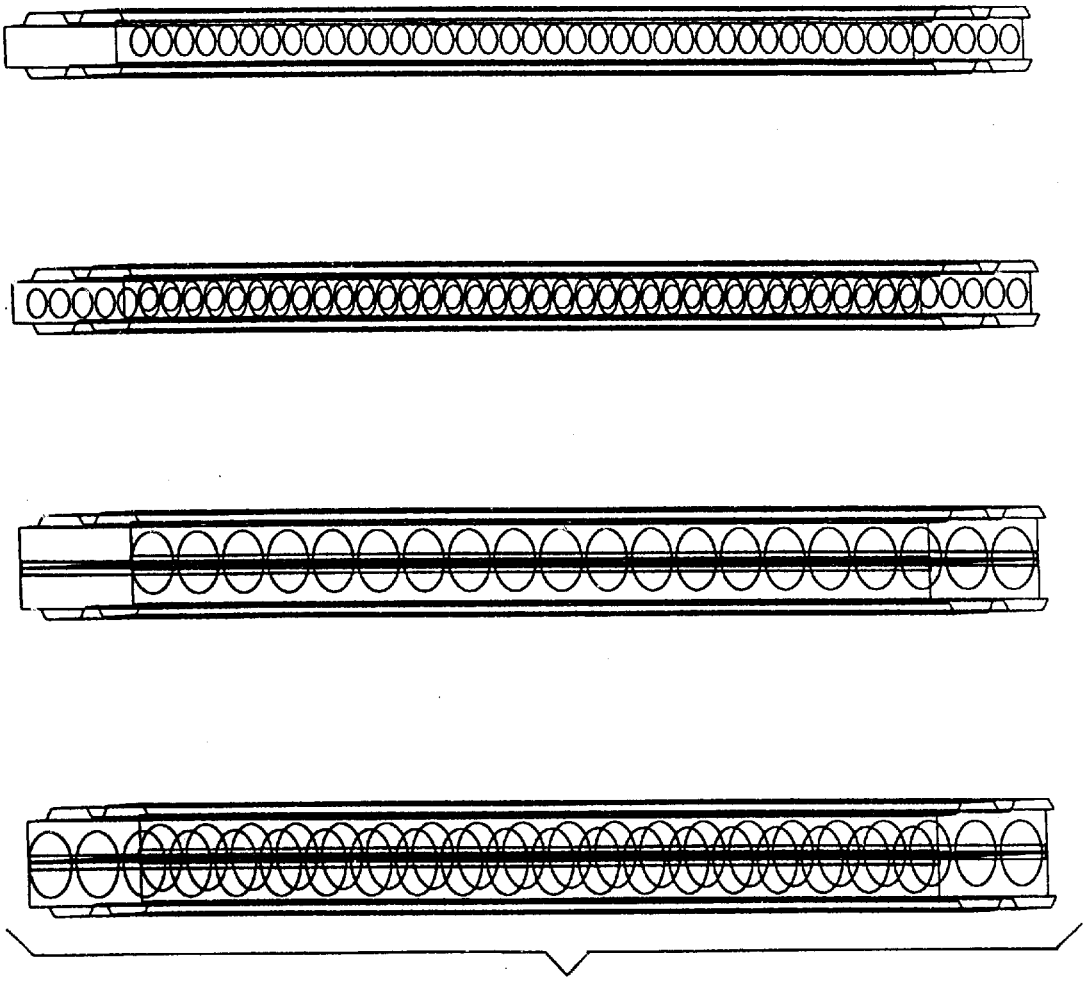
FIG. 17 shows alternative building panels in these instances with internal webs having apertures.

FIG. 17 also shows building panels wherein there are intermediate webs which are apertured.

Figure 18:
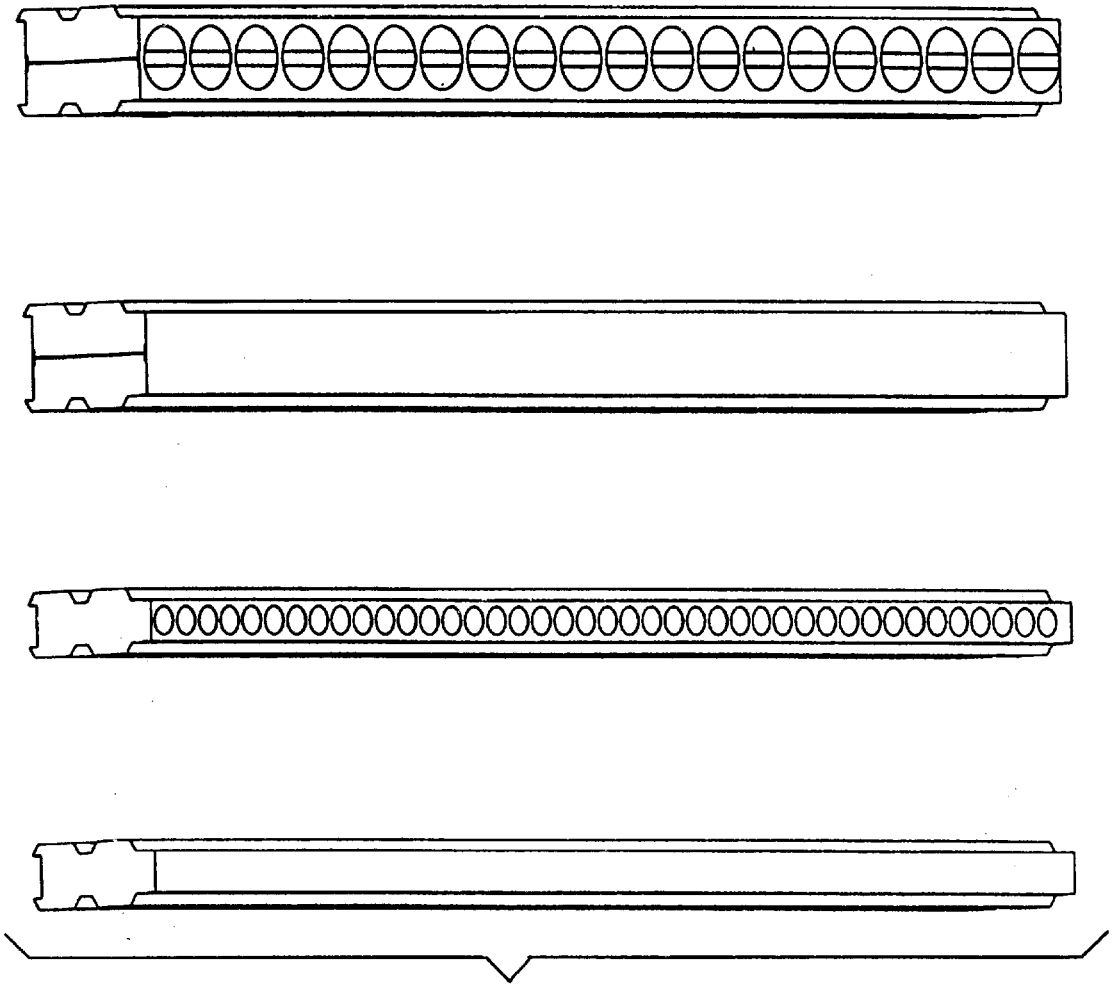
FIG. 18 shows various building panels.

FIG. 18 shows constructions similar to FIG. 17.

Figure 19:
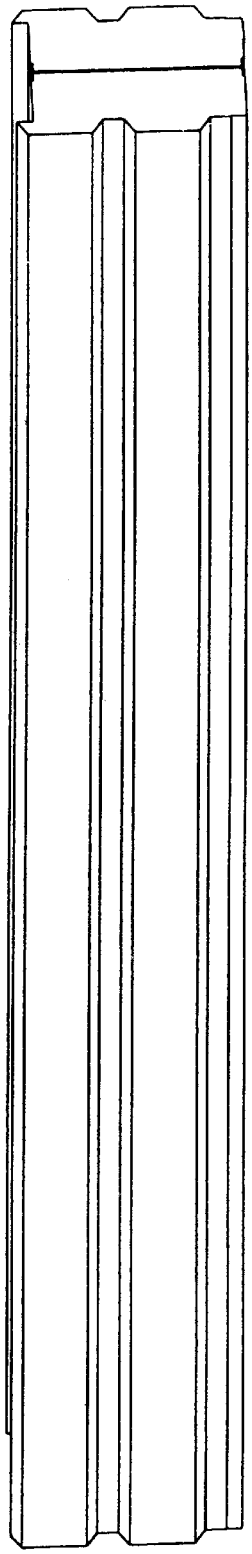
FIG. 19 shows another building panel.

FIG. 19 shows a panel 31 having a first end 32 and a second end 33.

In this instance the first end 32 and the second end 33 are so shaped as to enable the panel to be joined end to end with a light panel or to make right angle intersections with a light panel.

Figure 20:
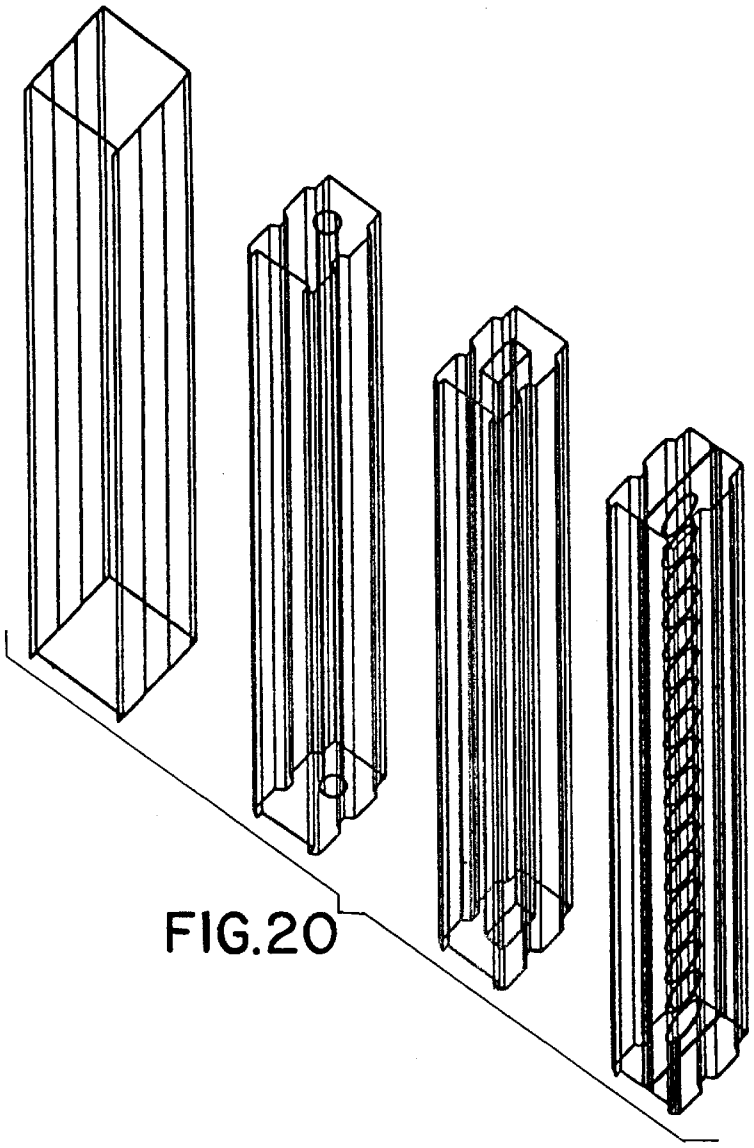
FIG. 20 shows various building panels.

FIG. 20 still further shows building panels in this instance having internal cores or webs to provide strength.

Figure 21:
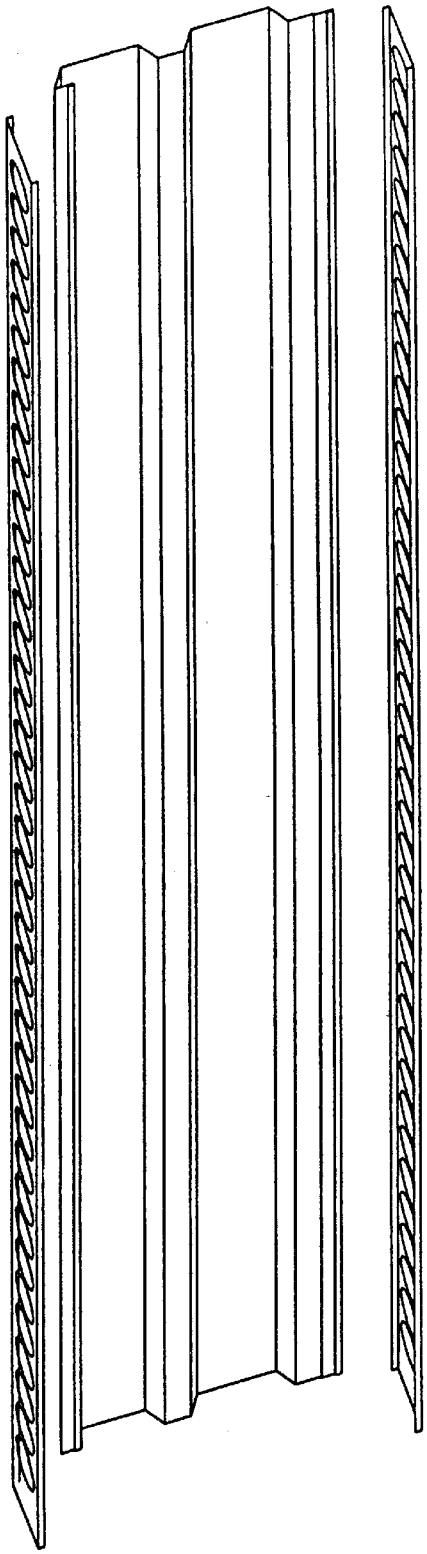
FIG. 21 shows elements used to make up a building panel.
Figure 24:
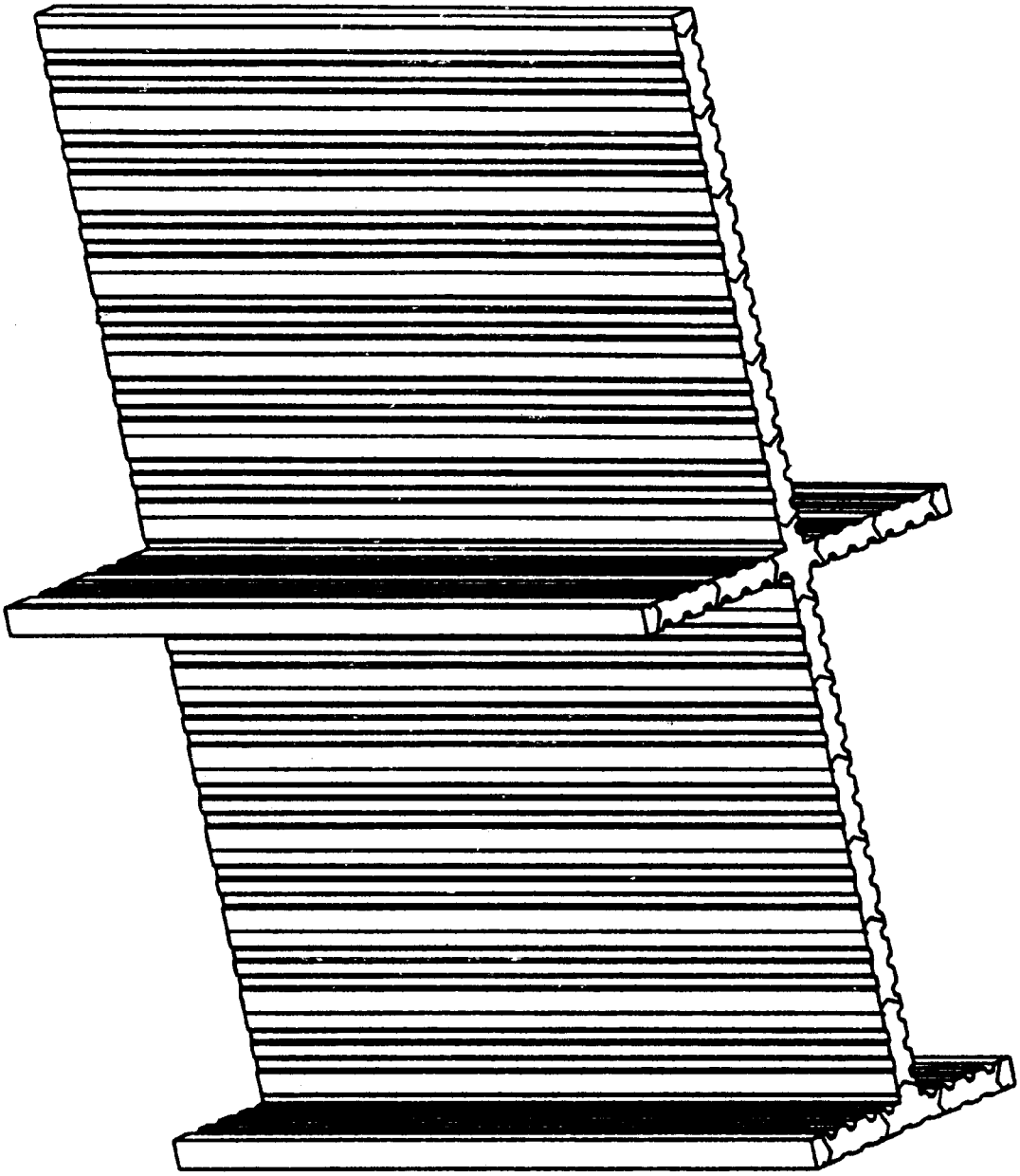
FIG. 24 shows a wall cross-section.
Figure 25:
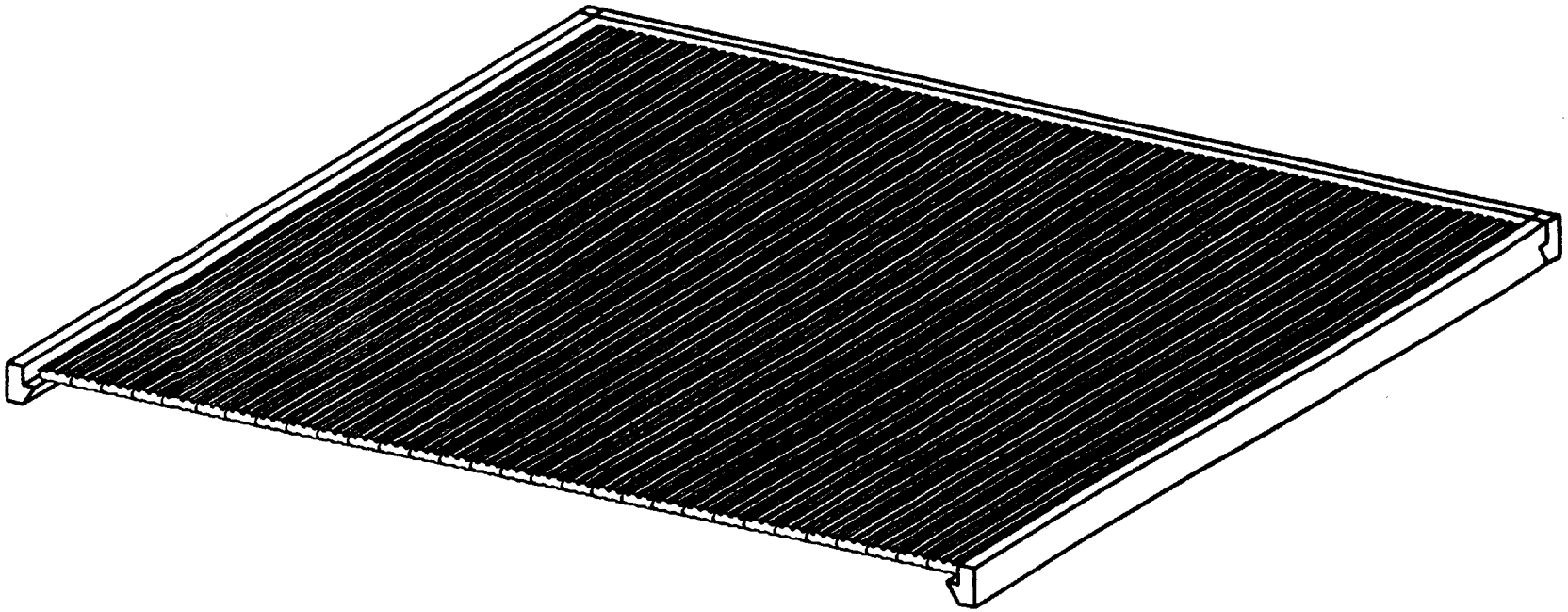
FIG. 25 shows a floor section with one side omitted.
Figure 26:
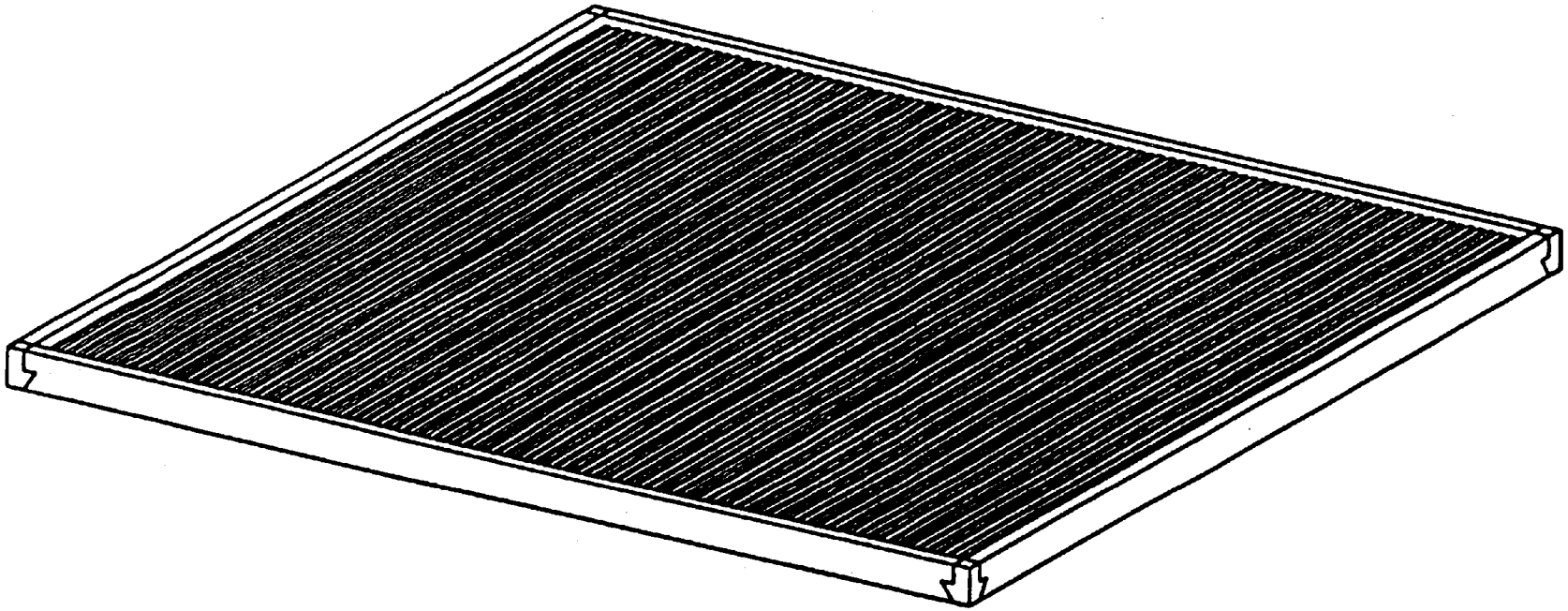
FIG. 26 shows a floor panel with all sides intact.
Figure 27:
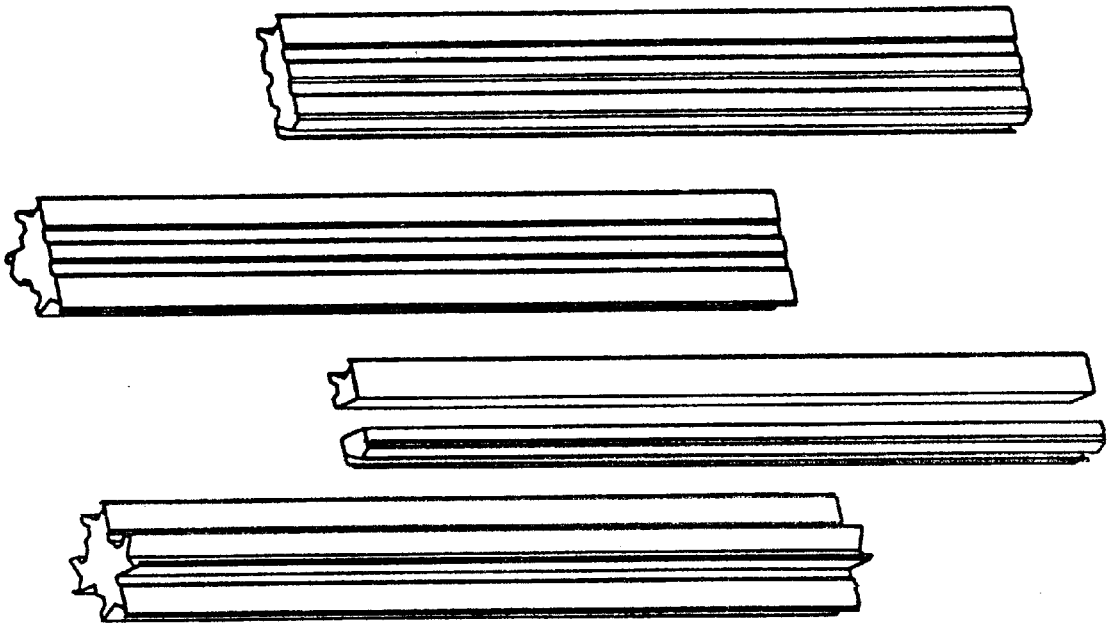
FIG. 27 shows further sections.

FIG. 21 shows a still further building panel in which the edges are apertured.

FIG. 22 is a drawing of components for another building element.

The sheathing used in the building panel of the present invention is preferably about 0.5 mm thick although thicker or thinner may be used.

The building panels of the present invention are excellent in constructing buildings and tend to be self bracing particularly when components extend at right angles to other components.

The building panels also have excellent strength in that the outer sheathing provides the tensile strength while the inner core provides compressive strength and due to the continuous nature of the outer sheath, this product thus allows a composite action while not requiring to adhere to each other.

The mechanism by which the sheath and the core interact when loaded to create this composite action can be illustrated by considering the distribution of forces when a panel such as the panel 1 of FIG. 1 is loaded with a sideways load pushing against face 8.

Such a load applied to a conventional steel reinforced panel would tend to cause bending of the panel, placing the concrete material adjacent face 8 into compression and the concrete material adjacent face 7 into tension, tending to cause tensile failure adjacent face 7. This sideways loading would also tend to cause the two edges 9 and 21 to move out of parallel, causing point f on edge 21 and point 1 on edge 9 to move away from each other, and causing point e on edge 21 and point m on edge 9 to move towards each other.

However, when such a load is applied to the panel of the present invention, the presence of the outer sheath 2 causes the sheath to place a compressive loading on the core 3 tending to prevent points 1 and f from moving away from each other. Conversely, the sheath 2 is then under a tensile load. The sheath 2 could be considered, in effect, to act as reinforcing material to the core 3 by a mechanism which does not require adhesion between the sheath 2 and the core 3.

Due to the particular construction and the substantial absence of substantial air gaps, the building panels are expected to have a high fire rating.

Further, in those instances in which there are internal webs, it is anticipated that the fire rating will be even higher still.

The claims defining the invention are as follows:

1. A building element comprising an outer sheath and an inner core, and being able to carry either or both of tensile loadings and compressive loadings without adhesion between the outer sheath and the inner core, the sheath being formed of a material having a greater tensile strength than compressive strength;

and the core being formed of a material having:

a greater compressive strength than tensile strength; and a density of less than 1,200 kg/cu meter;

wherein the outer sheath is longitudinally extending and has a first face and a second face which are spaced apart, first and second edges and a first end and a second end, wherein the first face and the second face are joined at the first and second edges to form the outer sheath as a continuous body, and wherein the first edge and the second edge are so shaped that the first edge of one such building element is adapted to locate in the second edge of another such building element.

2. A building element as claimed in claim 1, wherein the first end and the second end are so shaped that the first end of one such building element is adapted to engage with the second end of another such building element.

3. A building element as claimed in claim 1, wherein the sheath comprises at least two components which can interengage with one another to form the sheath.

4. A building element as claimed in claim 1, wherein the sheath comprises four components.

5. A building element as claimed in claim 4, wherein two components define the faces and two components define the edges.

6. A building element as claimed in claim 1, wherein the sheath is formed of mild steel, high tensile steel, carbon fibre materials, extruded materials, synthetic plastic-cement fibre composite and asbestos cement.

7. A building element as claimed in claim 1, wherein the core is formed of a cementitious or plaster material.

8. A building element as claimed in claim 7 wherein the core is formed of a material which has a density of 200 to 1200 kg/cu m.

9. A building element as claimed in claim 1, wherein the first face and the second face and/or the first edge and the second edge are joined by at least one web located intermediate of the edges.

10. A building element as claimed in claim 9, wherein said at least one web is apertured.

11. A building element comprising an outer sheath and an inner core, and being able to carry either or both of tensile loadings and compressive loadings without adhesion between the outer sheath and the inner core, the sheath being formed of a material having a greater tensile strength than compressive strength;

and the core being formed of a material having:

a greater compressive strength than tensile strength; and a density of less than 1,200 kg/cu meter;

wherein the outer sheath is longitudinally extending and has a first face and a second face which are spaced apart, first and second edges and a first end and a second end and wherein the first edge and the second edge are so shaped that the first edge of one such building element is adapted to locate in the second edge of another such building element and wherein, when so located, the core material of said one such panel is spaced not more than 3 mm from the core material of said another building element.

* * * * *